US005251920A

United States Patent [19]

McHale

[11] Patent Number: 5,251,920

[45] Date of Patent: Oct. 12, 1993

[54] BEAM OFF-SET ROLLER SKATE

[75] Inventor: Patrick McHale, Minneapolis, Minn.

[73] Assignee: T-Beam, Inc., Minneapolis, Minn.

[21] Appl. No.: 832,399

[22] Filed: Feb. 7, 1992

[51] Int. Cl.[5] ..... A63C 17/00

[52] U.S. Cl. ..... 280/11.19; 280/11.22; 280/11.27

[58] Field of Search ..... 280/11.19, 11.22, 11.27, 280/11.2

[56] References Cited

U.S. PATENT DOCUMENTS

| | | | |
|---|---|---|---|
| D. 158,076 | 6/1908 | Jack . | |
| 280,236 | 6/1883 | Phillips . | |
| 954,993 | 4/1910 | Peters . | |
| 1,188,377 | 6/1916 | Weaver . | |
| 2,245,769 | 11/1937 | Flamm . | |
| 2,868,553 | 3/1957 | Rieckman . | |
| 3,351,353 | 3/1965 | Weitzner . | |
| 3,696,877 | 10/1972 | Dessureault . | |
| 4,305,598 | 12/1981 | Brandner | 280/11.2 |
| 4,928,982 | 5/1992 | Logan | 280/11.22 |

FOREIGN PATENT DOCUMENTS

| | | | |
|---|---|---|---|
| 579406 | 7/1976 | Switzerland | 280/11.19 |

OTHER PUBLICATIONS

V-Line Ad Speedskating Times Sep. 1991.

*Primary Examiner*—Richard M. Camby

*Attorney, Agent, or Firm*—Harvey Kaye; Jerry Cohen

[57] ABSTRACT

Roller skates having a shoe or boot supported by a central support beam. The boot has an inside and outside corresponding to the inside and the outside of a user's foot to which it is designed to be removably attached. Each skate also has a first and second group of wheels in longitudinal alignment with the roller skate and in rotatable alignment with each other. The boot and groups of wheels are connected to a support structure. The first group of wheels is rotatably attached to the support structure and disposed to the outside thereof. The second group of wheels is rotatably attached to the support structure and disposed to the inside thereof. A first span between the most distant of the wheels of the first group of wheels is less than a second span between the most distant of the wheels of the second group of wheels. There are also brake means for slowing and stopping the roller skate when a user desires.

17 Claims, 3 Drawing Sheets

BEAM OFF-SET ROLLER SKATE

FIELD OF THE INVENTION

The present invention relates generally to roller skates, and, more particularly, to skates for skating in a manner similar to inline skating, but wherein separate sets or groups of wheels are positioned on respective sides of the skate and/or on respective sides of a central support member.

BACKGROUND OF THE INVENTION

Inline roller skating has now become a popular recreational activity. In response to this, a growing commercial market for such skates has developed in the United States and elsewhere.

The term "inline skating" is derived from the arrangement of the skate's wheels. According to the inline arrangement, the wheels of the skate are arranged longitudinally one behind the other or in tandem so that the wheels rotate in the same longitudinally oriented vertical plane, similar to ice skating where there is a blade all in one plane. Further, the axles of each wheel are generally oriented in the same horizontal plane. This alignment results in an arrangement of wheels approximating the footprint of the blade of an ice skate.

It is recognized in the industry that by arranging the wheels of the roller skate in the same vertical plane, resistance to turning the skate is minimized. This arrangement, however, provides little or no latitudinal support for the skate. As a consequence of this lack of support, a great deal of stress is placed on the skater's lower leg, particularly the skater's ankle. The industry has responded to this problem by producing inline skates with rigid plastic boots that provide support for the user's ankles. To be effective, these boots must rise at least above the user's ankle, but many of the boots in use rise approximately halfway up the user's calf.

Although adoption of the plastic boot by the inline skating industry has reduced the stability problems associated with inline skates, it has created another set of problems. First, plastic boots generally do not breath, that is, they do not allow for the transfer of perspiration out and away from the user's foot during use. Secondly, the rigid plastic boots often do not conform as well to the shape of the user's foot as boots fabricated from more pliable materials, such as leather. And, thirdly, because of the bulkiness of the plastic boots required, the boots are heavier and less aerodynamically designed than those fabricated from materials such as leather.

The present invention addresses these and other problems associated with the use of roller skates by individuals for competitive and recreational use. The present invention also offers other advantages over the prior art, and solves other problems associated therewith.

SUMMARY OF THE INVENTION

The present invention provides a roller skate to be worn by a person, wherein each foot of the person has an inside, an outside, and a shape which is generally a mirror image of the other. The roller skate includes a product for holding the roller skate onto the foot of a user, preferably a boot or the like, which is secured to a user's foot. Such a product includes an inside and outside, respectively, corresponding to the inside and the outside of the respective foot to which it is designed to be worn. The skate also includes a first group or plurality of wheels generally in longitudinal alignment with the roller skate and generally in rotatable alignment with each other, and a second group or plurality of wheels generally in longitudinal alignment with the roller skate and generally in rotatable alignment with each other. The skate further includes a support arrangement for supporting such boot or other foot adherence means and the first and second groups of wheels, such support arrangement including a first side disposed to the outside of such boot or the like and a second side disposed to the inside of such boot. The first plurality of wheels is rotatably interconnected to such supporting arrangement and disposed to the first side thereof. The second plurality of wheels is rotatably interconnected to such supporting means and disposed to the second side thereof. A first span between the most distant of the first plurality of wheels is less than a second span between the most distant of the wheels of the second plurality of wheels.

The present invention, unlike the inline skates currently available, eliminates the need for heavy plastic boots to provide ankle support and stability. This is accomplished by providing the skate with two sets of inline wheels, separated by a relatively small but important distance transverse to the length of the skate between the first and second plurality of wheels. This separation enhances the latitudinal stability of the skate, thus reducing the stress on the user's ankles.

This enhanced stability further allows the user of boots fabricated from leather or other lightweight, pliable material, rather than the heavier and more rigid molded plastic boots currently in use. Such currently used boots are virtually required for use with the prior art "inline" skates, so that the substitution of lightweight material, such as leather, for plastic in boot construction provides several advantages. First, when a breathable material such as leather is used for construction of the boot, moisture in the form of perspiration will more readily move away from the user's foot than when using the plastic boots. Second, boots fabricated from more pliable materials, such as leather, allow for a better fit than the currently used plastic boots. Thirdly, eliminating the need for the bulky plastic boots, reduces the weight and can improve the aerodynamic characteristics of the skate.

The present invention, while providing enhanced stability, also offers improved turning ability over conventional inline skates. This advantage of the present invention stems from the variation in span between the most distant of the wheels in each plurality of wheels. The skater uses the longer span, found on the inside set of wheels, primarily for accelerating, maintaining speed, or initiating turns, by placing the skate on the inside plurality and pushing the skate out and back against the skating surface. The greater span provides the skater with a longer region of wheels-to-surface contact and creates a longitudinally stable platform for accomplishing these maneuvers. When the skater is turning, however, the skater will inevitably lean to the inside radius of the turn he or she is making and generally rely on the outside pair of wheels on the foot toward the inside of the turn for guiding contact with the skating surface. In such a circumstance, the skater will generally put most, if not all, of his or her weight on those wheels, unless striding through the turn in several crossover strides. In the latter case the outside foot would probably be pushing away on the three inner wheels of the outside skate, but the weight would still be largely supported by the two outer wheels of the inner skate when these wheels are engaged with the skating surface. The shorter the span of this outside plurality of wheels, the more this short span facilitates the negotiation of the turn.

The present invention also provides extra padding in the area of the heel and the arch to protect and support the foot better and to prevent ulcers from developing on the feet of skaters. A braking device may also be attached to assist the skater in stopping or in slowing down.

These advantages and other objects obtained with this invention are further explained hereinafter with more particularity and by reference to the preferred embodiments as shown in the following drawings.

BRIEF DESCRIPTION OF THE DRAWINGS

In the drawings, in which like reference numerals indicate corresponding parts of the preferred embodiments of the present invention to the several views.

DETAILED DESCRIPTION OF THE PREFERRED EMBODIMENTS

Figure 1:
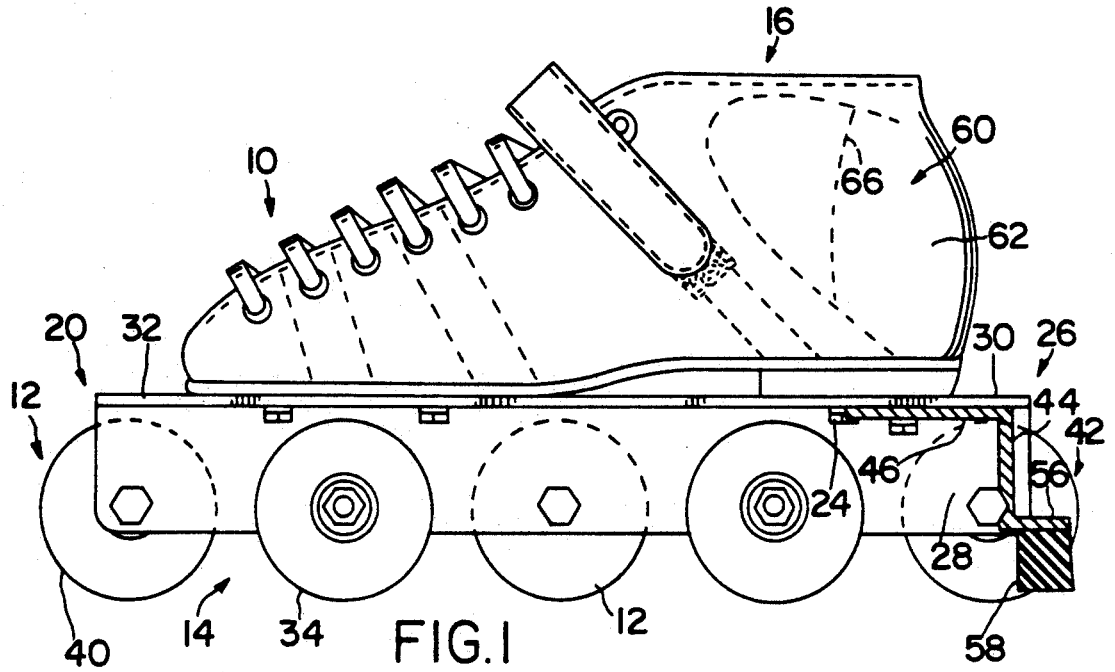
FIG. 1 is a side elevational view of a roller skate.

Referring now to the drawings, and more particularly to FIG. 1, a roller skate in accordance with the present invention is designated generally by the numeral 10. Skate 10 includes first rolling assembly 12 with which a user can push against a skating surface for the purpose of acceleration and second rolling assembly 14 which a user can use to guide and stabilize himself/herself with respect to the surface. Some means is provided to hold the surface contacting portion of the device to a user's foot. Usually this is a shoe or boot 16 which is worn by, or attached to, the user and holds the pushing assembly and the guiding assembly with respect to the user.

Shoe or boot 16 commonly includes an arrangement for supporting the pushing and guiding assemblies 12, 14. The shoe or boot 16 is attached to a support assembly 20 with a plurality of screws 24 or equivalent fastening mechanism. Because the present invention creates a solid platform with the support assembly 20 upon which the shoe 16 can be firstly attached in several places, shoe 16 need not be a rigid plastic boot as has been adopted in recent years in the inline skating industry. Rather, the stability of apparatus in accordance with the present invention allows the use of a standard leather speed boot. A speed boot has the advantages of a better fit, lighter weight, better aerodynamics, and much better heat dissipation than conventional molded plastic, ski-type, inline boots.

Support assembly 20 comprises a central support beam 26 oriented in longitudinal alignment with the length of shoe 16. Central support beam 26 preferably has a generally vertical support member 28 interconnected with a generally horizontal support member 30. The plane of vertical support member 28 is generally perpendicular to the plane of horizontal support member 30 such that any transverse cross-sections appear in the shape of a "T". Shoe 16 rests on upper surface 32 of the horizontal support member 30. As indicated, a plurality of screws 24 of nut and bolt combinations or some equivalent fastening mechanism are used to fasten the sole of shoe 16 to horizontal support member 30. Hence, a plurality of openings are formed in horizontal support member 30 to receive screws 24.

People's feet have an arch or instep on the inside of each foot and a more continuous profile on the outside of each foot, one foot being the mirror image of the other. Likewise, a shoe or boot has an inside and outside corresponding to the inside and outside of a skater's foot. Rolling assembly 12 provides for pushing, and rolling assembly 14 provides for guiding, and are located with specific consideration of these different sides and with how they relate to the mechanics of skating.

Figure 2A:
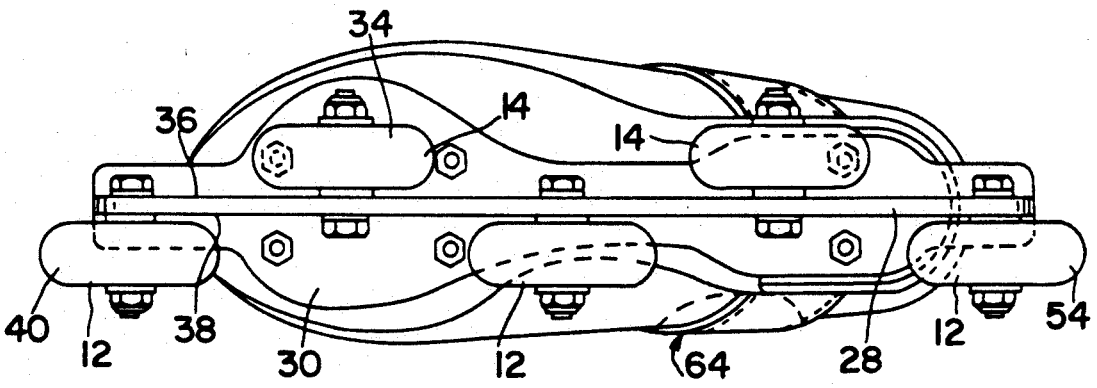
FIG. 2A is a bottom view of a roller skate, such as that shown in FIG. 1, but designed specifically for being worn on the left foot.

Guiding assembly 14 includes a first group of wheels 34 located generally in longitudinal alignment with the roller skate 10 and in rotatable alignment with each other. Vertical support member 28 has a first side 36 corresponding to the outside of shoe 16 and also has a second side 38 corresponding to the inside of shoe 16 (See FIG. 2A). The wheels 18 of rolling assembly 34 are rotatably attached in a manner known to those skilled in the art to vertical support member 28 such that they are disposed along the first side. Pushing assembly 12 includes a second group of wheels 22 generally in longitudinal alignment with roller skate 10 and generally in rotatable alignment with each other. The wheels 22 of rolling assembly 40 are rotatably attached to vertical support member 28 in a fashion known to those skilled in the art. Wheels 18 are disposed on the other side. Wheels 18 and 22 are preferably spaced an equal distance from the central plane of vertical support member 28 and are separated laterally from each other a distance "Y" (See FIG. 3A).

Figure 2B:
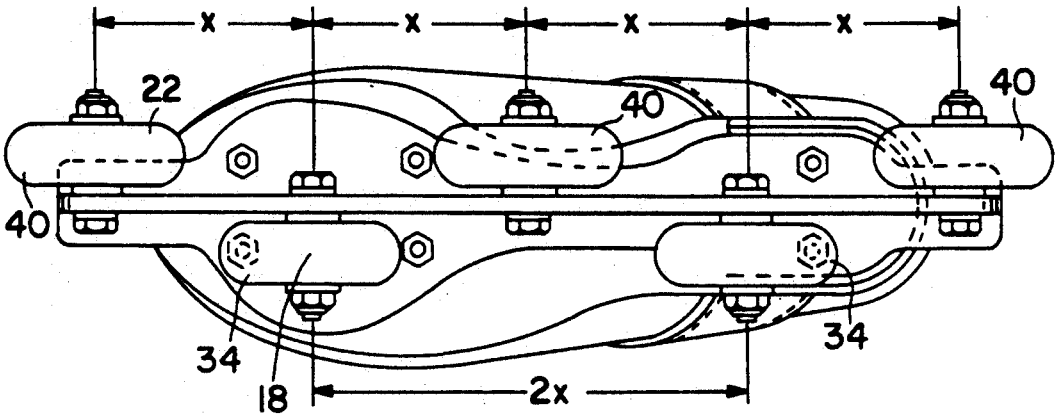
FIG. 2B is a bottom view of a roller skate such as that shown in FIG. 1, but designed specifically for being worn on the right foot.

The first and second groups of wheels 34, 40 are not only distinguished by being on opposite sides of vertical support member 28, but also in that a first span between the most distant of wheels 18 is less than a second span between the most distant of wheels 22. In one of the preferred embodiments, the first group of wheels 34 includes two wheels 18, while the second group of wheels 40 includes three wheels 22. The second group of wheels 40 may be identified by first, second and third wheels 22 which are aligned in numerical order and spaced a distance, preferably 2× (See FIG. 2B). Individual wheels 18 of the first group are individually staggered latitudinally between the first and second wheels 22 and second and third wheel 22, respectively. Wheels 18 are also preferably spaced a distance of 2×, and each is longitudinally centered between a pair of wheels 40.

The T-shape of the supporting mechanism allows the first and second groups of wheels to be mounted on opposite sides of the vertical support member and leads to significantly improved "tracking stability"—over conventionally known skates. Such utility allows a skater to brake in a more controlled fashion. In fact, such offset groups of wheels allows precise control in various skating situations, such as, dancing, backward skating, jumping, etc., while still allowing the skates to be viable five wheel speed skates.

At the back of the shoe or boot 16 there is a stop unit or brake 42, which, in the form shown here, is a "Z" shaped bracket 44 having an opening in the higher horizontal leg 46 for mounting to the horizontal support unit 30 by a bolt and nut 48. The lower end of the unit can be constructed having a bearing 50 mounted on the axle 52 of the rearmost wheel 54 and the lower horizontal leg 56 has a rubber pad 58 for scraping against the ground when the user wishes to slow down or to stop. By simply providing more weight to the rear portion of the skate having the stop unit 42, forces the rubber 58 to press against the ground and thus the skater to slow down, at a rate which is controlled by the user in the amount of rearward force placed on the back of the foot which has the stop unit, for those which only have a stop unit 42 on one of the two skates. However, stop units 42 may be placed onto both skate if desired.

There is extra padding 60 inside the shoe 16 in two locations where there is particularly heavy pressure placed upon a skater's foot. These are at the heel 62 and at the arch 64. As shown in FIG. 1 there is a dashed line 66 which indicates the end of the padding on the left side of the left foot and includes the left portion of the heel, and it would also be on the right side of the right foot and includes the right portion of the heel.

Figure 3A:
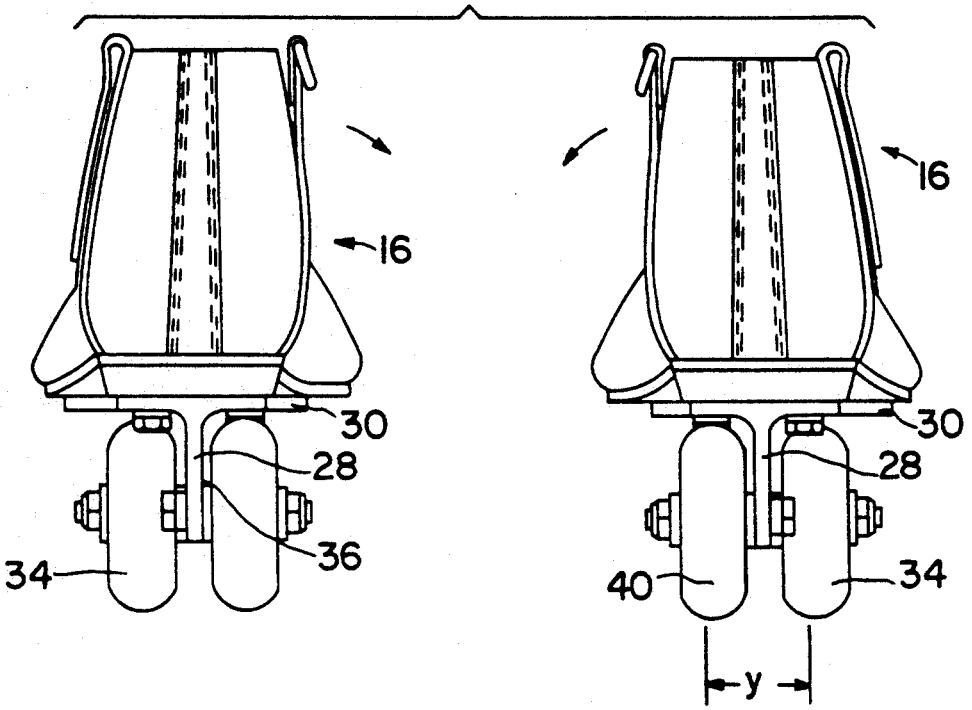
FIG. 3A is a rear view of the left and right foot skates in a straight tracking position where all wheels engage the skating surface.
Figure 3B:
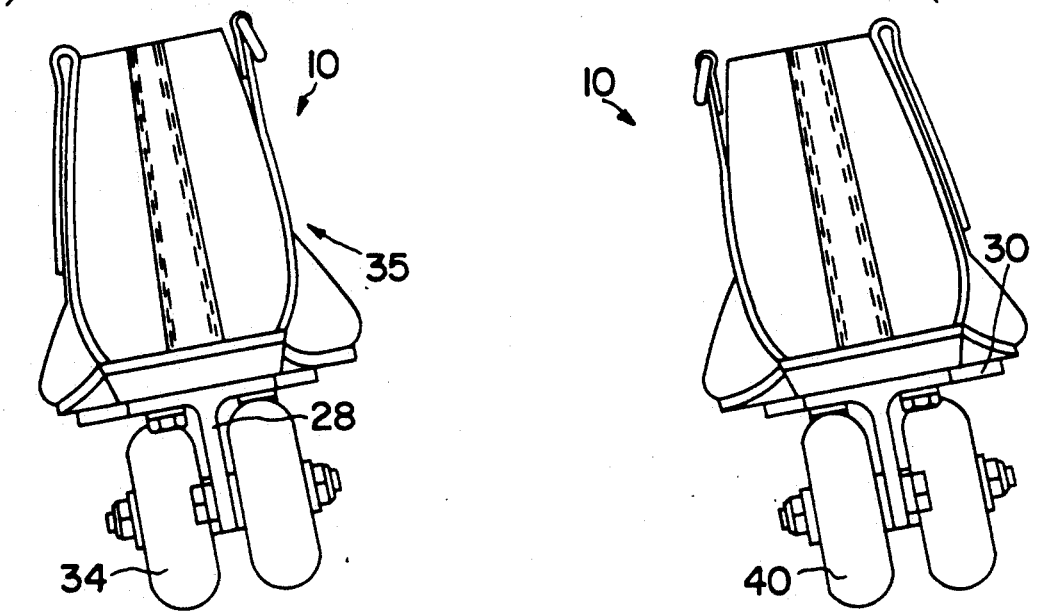
FIG. 3B is a rear view of the left and right foot skates in a possible simulation of a left-hand turning position where the outside wheels of the inside skate and the inside wheels of the outside skate are engaged with the skating surface.
Figure 4:
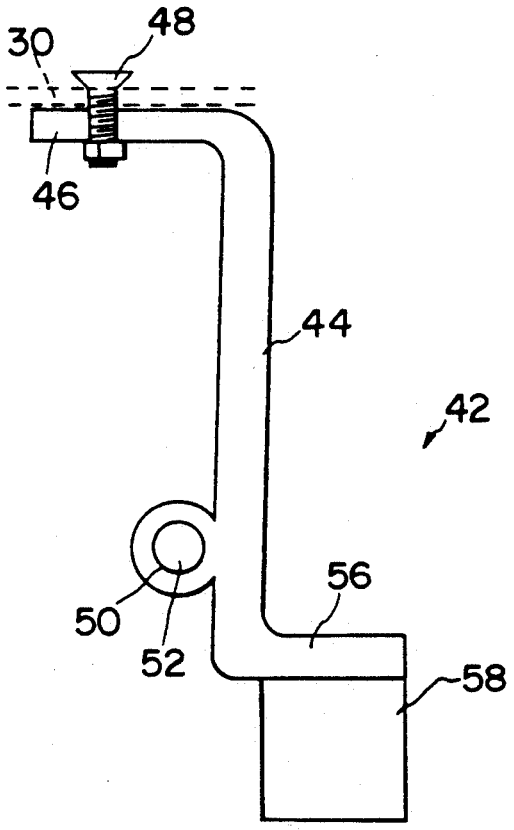
FIG. 4 is an enlargement of the rear portion of the skate stop unit shown in FIG. 1.

In use, the skates function similar to "inline" skates, except they have considerably more stability (See FIG. 3A). As mentioned, leather speed skating shoes can be used rather than plastic molded boots. Once a skater puts the shoes on, he/she has considerable stability due to the two groups of wheels which are offset so that the shoe itself need not be stiffened rigid to provide stability. To initially accelerate, a skater inclines one foot with respect to a line of travel directly forward and pushes off against the three inside wheels 22. Then the second skate is placed against the skating surface and as if coasts, the weight of the skater leans against the incline and pushes off again to further accelerate. This is repeated in the usual "hockey" skating fashion. In rounding a corner (See FIG. 3B), the skater pushes with the second group of wheels 40 of one skate against the skating surface to accelerate around the corner. Since the skater is leaning toward the inside of the turn, after pushing with the outside skate, the skater puts weight on the inside skate 35 and primarily coasts on the skating surface with the first group of wheels 34. The outside leg is then brought forwardly for another push and the procedure alternates in the usual ""hockey" skating fashion.

The present skate has all the advantages of an inline skate, but further has better stability which allows use of a shoe rather than a molded boot leading to the many advantages already discussed. The present skate provides a unique cornering technique which makes cornering easier and allows for sharper cornering than with conventional five wheel in-line skates having all wheels along the same vertical plane. The shorter span of the second group of wheels allows the skater to turn more sharply in a controlled fashion.

Thus, the preferred embodiment of the present invention is described in detail with advantages and characteristics given. It is understood, however, that the disclosure illustrative and to the degree that various changes are made, especially with respect to matters of shape, size and arrangements that the principle of the present invention extends fully to the general meaning of the terms in the appended claims.

What is claimed is:

1. A roller skate to be worn on the feet of a user, the roller skate comprising:

(a) mounting means for attachment to the foot of a user having an inside and an outside, respectively, corresponding to the inside and the outside of the respective user's foot on which it is designed to be worn;

(b) a first group of wheels generally in longitudinal alignment with the roller skate and generally in rotatable alignment with each other;

(c) a second group of wheels generally in longitudinal alignment with the roller skate and generally in rotatable alignment with each other; and (d) foot support means arranged to fit the feet of a user and having the mounting means connected thereto, said foot support means having a first side disposed to the outside of said mounting means and a second side disposed to the inside of said mounting means;

said first group of wheels being rotatably attached to said mounting means and disposed to the outside thereof, said second group of wheels being rotatably attached to said mounting means and disposed to the inside thereof, and a first span between the most distant of the wheels of the outside group of wheels is less than a second span between the most distant of the wheels of the inside group of wheels, the first group of wheels including two wheels and the second group of wheels including three wheels.

2. The roller skate in accordance with claim 1 wherein the second group of wheels includes first, second and third wheels which are aligned in numerical order, wherein the individual wheels of the first group of wheels are individually staggered latitudinally between the first and second wheels and the second and third wheels, respectively.

3. A roller skate to be worn on the feet of a user, the roller skate comprising:

(a) mounting means for attachment to the foot of a user having an inside and an outside, respectively, corresponding to the inside and the outside of the respective user's foot on which it is designed to be worn;

(b) a first group of wheels generally in longitudinal alignment with the roller skate and generally in rotatable alignment with each other;

(c) a second group of wheels generally in longitudinal alignment with the roller skate and generally in rotatable alignment with each other; and (d) foot support means arranged to fit the feet of a user and having the mounting means connected thereto, said foot support means having a first side disposed to the outside of said mounting means and a second side disposed to the inside of said mounting means;

said first group of wheels being rotatably attached to said mounting means and disposed to the outside thereof, said second group of wheels being rotatably attached to said mounting means and disposed to the inside thereof, and a first span between the most distant of the wheels of the outside group of wheels is less than a second span between the most distant of the wheels of the inside group of wheels, the mounting means being a central support beam extending in longitudinal alignment with the foot support means.

4. A roller skate comprising:

(a) a central support beam in longitudinal alignment with the roller skate, said central support beam having an inside and an outside;

(b) a first group of wheels supported by said beam in longitudinal alignment with the roller skate and in rotatable alignment with each other; and (c) a second group of wheels supported by said beam in longitudinal alignment with the roller skate and in rotatable alignment with each other;

said first group of wheels being rotatably interconnected to said central support beam and disposed to the first side thereof, said second group of wheels being rotatably interconnected to said central support beam and disposed to a second side thereof, wherein the respective first and second groups of wheels are disposed to opposite sides of said central support beam, a first span between the most distant of the wheels of the outside group of wheels being less than a second span between the most distant of the wheels of the inside group of wheels.

5. A roller skate comprising:

(a) a central support beam in longitudinal alignment with the roller skate, said central support beam having an inside and an outside;

(b) a first group of wheels supported by said beam in longitudinal alignment with the roller skate and in rotatable alignment with each other; and (c) a second group of wheels supported by said beam in longitudinal alignment with the roller skate and in rotatable alignment with each other;

said first group of wheels being rotatably interconnected to said central support beam and disposed to the first side thereof, said second group of wheels being rotatably interconnected to said central support beam and disposed to a second side thereof, wherein the respective first and second groups of wheels are disposed to opposite sides of said central support beam, the outside group of wheels includes two wheels and the inside group of wheels including three wheels.

6. The roller skate in accordance with claim 5, wherein the second group of wheels includes first, second and third wheels which are aligned in numerical order, wherein the individual wheels of the first group of wheels are individually staggered latitudinally between the first and second wheels and the second and third wheels, respectively.

7. A roller skate comprising:

(a) a central support beam in longitudinal alignment with the roller skate, said central support beam having an inside and an outside;

(b) a first group of wheels supported by said beam in longitudinal alignment with the roller skate and in rotatable alignment with each other; and (c) a second group of wheels supported by said beam in longitudinal alignment with the roller skate and in rotatable alignment with each other;

said first group of wheels being rotatably interconnected to said central support beam and disposed to the first side thereof, said second group of wheels being rotatably interconnected to said central support beam and disposed to a second side thereof, wherein the respective first and second groups of wheels are disposed to opposite sides of said central support beam, there being a greater number of wheels disposed on the second side as compared to the number of wheels disposed on the first side.

8. A roller skate, comprising:

(a) means for holding a roller skate onto the foot of a user, and having an inside and an outside, respectively, corresponding to the inside and the outside of the respective foot of a user to which it is designed to be worn;

(b) a central support beam supporting said foot holding means and extending in longitudinal alignment therewith, said central support beam having a first side disposed to the outside of said foot holding means and a second side disposed to the inside of said foot holding means;

(c) a first group of wheels supported by said beam generally in longitudinal alignment with the roller skate and generally in rotatable alignment with each other, and (d) a second group of wheels supported by said beam generally in longitudinal alignment with the roller skate and generally in rotatable alignment with each other, said first group of wheels being rotatably interconnected to said central support beam and disposed to the first side thereof, said second group of wheels being rotatably interconnected to said central support beam and disposed to the second side thereof, a first span between the most distant of the wheels of the first group of wheels being less than a second span between the most distant of the wheels of the second group of wheels.

9. A roller skate, comprising;

(a) means for holding a roller skate onto the foot of a user, and having an inside and an outside, respectively, corresponding to the inside and the outside of the respective foot of a user to which it is designed to be worn;

(b) a central support beam supporting said foot holding means and extending in longitudinal alignment therewith, said central support beam having a first side disposed to the outside of said foot holding means and a second side disposed to the inside of said foot holding means;

(c) a first group of wheels supported by said beam generally in longitudinal alignment with the roller skate and generally in rotatable alignment with each other, and (d) a second group of wheels supported by said beam generally in longitudinal alignment with the roller skate and generally in rotatable alignment with each other, said first group of wheels being rotatably interconnected to said central support beam and disposed to the first side thereof, said second group of wheels being rotatably interconnected to said central support beam and disposed to the second side thereof, the first group of wheels including two wheels and the second group of wheels including three wheels.

10. The roller skate in accordance with claim 9, wherein the second group of wheels includes first, second and third wheels which are aligned in numerical order, wherein the individual wheels of the first group of wheels are individually staggered latitudinally between the first and second wheels and the second and third wheels, respectively.

11. A roller skate, comprising;

(a) means for holding a roller skate onto the foot of a user, and having an inside and an outside, respectively, corresponding to the inside and the outside of the respective foot of a user to which it is designed to be worn;

(b) a central support beam supporting said foot holding means and extending in longitudinal alignment therewith, said central support beam having a first side disposed to the outside of said foot holding means and a second side disposed to the inside of said foot holding means;

(c) a first group of wheels supported by said beam generally in longitudinal alignment with the roller skate and generally in rotatable alignment with each other, and (d) a second group of wheels supported by said beam generally in longitudinal alignment with the roller skate and generally in rotatable alignment with each other, said first group of wheels being rotatably interconnected to said central support beam and disposed to the first side thereof, said second group of wheels being rotatably interconnected to said central support beam and disposed to the second side thereof, there being a greater number of wheels disposed on the second side as compared to the number of wheels disposed on the first side.

12. A roller skate comprising:

(a) a central support beam having first and second sides;

(b) a first group of wheels; and (c) a second group of wheels wherein said first group of wheels includes two wheels and is disposed on and rotatably interconnected to the first side of said central support beam; said second group of wheels includes three wheels and is disposed on and rotatably interconnected to the second side of said central support beam; and wherein a first span between the most distant of the plurality of wheels disposed on the first side is less than a second span between the wheels disposed on the second side.

13. A roller skate as defined in claim 11, wherein the plane of each wheel is perpendicular to the ground when the wheel is at rest.

14. A roller skate as defined in claim 11, wherein said foot holding means is a shoe and the plane of each wheel is perpendicular to the sole of the shoe.

15. A roller skate as defined in claim 11, wherein said foot holding means is a shoe, and the first wheel is in front of the toe of the shoe and the last wheel is behind the heel of the shoe.

16. A roller skate as defined in claim 11, wherein a first span between the most distant of the wheels of the first group of wheels is less than a second span between the most distant of the wheels of the second group of wheels, the first group of wheels includes two wheels and the second group of wheels includes three wheels, the second group of wheels includes first, second and third wheels which are aligned in numerical order, wherein the individual wheels of the first group of wheels are individually staggered latitudinally between the first and second wheels and the second and third wheels, respectively.

17. A roller skate as defined in claim 11, wherein each group of wheels is adjacent said beam.

* * * * *